US006510676B1

(12) United States Patent
Gauthier

(10) Patent No.: US 6,510,676 B1
(45) Date of Patent: Jan. 28, 2003

(54) DEVICE FOR FEEDING TABLETS TO BLISTER PACKS

(75) Inventor: Denis Gauthier, Beaumont (FR)

(73) Assignee: Entreprise de Mecanique et d'Outillage, Thiers (FR)

( * ) Notice: Subject to any disclaimer, the term of this patent is extended or adjusted under 35 U.S.C. 154(b) by 0 days.

(21) Appl. No.: 09/831,504

(22) PCT Filed: Oct. 19, 1999

(86) PCT No.: PCT/FR99/02538

§ 371 (c)(1),
(2), (4) Date: Jun. 26, 2001

(87) PCT Pub. No.: WO00/29288

PCT Pub. Date: May 25, 2000

(30) Foreign Application Priority Data

Nov. 13, 1998 (FR) ..... 98 14444

(51) Int. Cl.[7] ..... B65B 1/36
(52) U.S. Cl. ..... 53/501; 53/534; 53/246
(58) Field of Search ..... 53/501, 534, 246, 53/248

(56) References Cited

U.S. PATENT DOCUMENTS 4,183,192 A * 1/1980 Smaw ..... 53/151
4,570,419 A * 2/1986 Tinsley et al. ..... 221/251
5,911,667 A * 6/1999 Sanchis et al. ..... 193/3
6,345,487 B1 * 2/2002 Luciano et al. ..... 53/147

FOREIGN PATENT DOCUMENTS

| | | |
|---|---|---|
| DE | 31 16 481 A1 | 12/1982 |
| DE | 38 42 273 A1 | 6/1989 |
| FR | 2 759 346 | 8/1998 |
| WO | WO 97/11884 | 4/1997 |

* cited by examiner

*Primary Examiner*—Ted Kavanaugh
(74) *Attorney, Agent, or Firm*—Oliff & Berridge, PLC

(57) ABSTRACT

This device includes a single enclosure (7) containing and carrying the reservoir (A), the dispenser (B), and the distributor (C) made of cylindrical and rotary brushes (39*a* to 39*c*), and the dispenser (B) having two parallel flaps (15, 16) which come into closure contact against the upstream transverse wall (12*a*) of the enclosure (7), near to the blister sheet (5), and are linked, by their posterior ends, to independent motors (18, 19) able to move the flaps in one direction or the reverse, the control of the opening and closing of each flap (15 and 16) reacting, in respect of the upper flap (15), to a volumetric sensor (34) detecting the quantity of tablets accumulated in the buffer bay (40) and, in respect of the lower flap, to a sensor (38) disposed above the blister sheet (5), upstream of the first brush (39*a*).

11 Claims, 4 Drawing Sheets

7
24
25
26
23
18
18a
18b
19
19a
19b
20
22
28
29
39c
39b
39a
P
D
11
42
16
15
C
17
B
A
14a
36c
36a
36
36b
38
37
32b
32a
30
32
34
31
40
35
13
12a
12
6
4
5
14
41

DEVICE FOR FEEDING TABLETS TO BLISTER PACKS

BACKGROUND OF THE INVENTION

1. Field of the Invention

The invention relates to a device for feeding tablets, or the like, to blisters made in a travelling sheet of synthetic material, and for example the blisters of cards thermoformed in a web of synthetic material subsequently receiving a closure film.

Such devices are disposed above the trajectory of travel of a blister sheet, moved for example by a belt conveyor.

2. Discussion of Related Art

The current devices use vibratory feeders which select, orient, and dispatch the tablets to a means for filling the blisters, comprising dispensing means and distributing means, such as brushes, rectilinear or rotary, guaranteeing the entry of each tablet into a blister.

By reason of the diversity of shapes and dimensions of the tablets and of the orientation of the blisters, namely, parallel, transverse, or inclined with respect to the direction of movement of the sheet, each dispenser can dispense only one or perhaps two types of tablets. Moreover, it is in general specific to a packaging installation and can no longer be transferred over to another installation. A consequence of this is to limit an installation to the dispensing of certain tablets and to not be able to adapt it rapidly for the dispensing of other tablets, when demand for these latter becomes greater.

To this drawback, which involves increasing the number of specialized installations so as to cope with diversified demand, are added those resulting from the dispensing conditions. Specifically, in current devices the stream of tablets is poorly controlled, so that chips and dust may form in the dispensing circuit, through joggling or jamming which engender damage to the tablets. This causes the provision of incomplete packaging or of packaging containing defective tablets and/or dust affecting not only the aesthetic appearance, but also the hygiene of the packaging.

Such is the case in the document DE-A-9 842 273 in which the hopper of a storage reservoir dispenses a batch of tablets under gravity into a temporary reservoir formed in the distributing device, upstream of rectilinear distributing brushes, and in which the surplus product is sucked up and recycled.

SUMMARY OF THE INVENTION

The object of the present invention is to remedy these drawbacks by providing a device affording complete and regular filling, without damaging the dispensed tablets, and which can very rapidly be transferred from one installation to another, while being able to receive tablets of different shapes and dimensions, thereby improving the loading schedule of each packaging installation, and that of a plant.

To this end, the device according to the invention consists of a single enclosure containing and carrying the storage reservoir, the dispensing means, and the distributing means consisting of cylindrical and rotary brushes. The dispensing means consists of two parallel flaps which, forming the bottom of the reservoir and delimiting a buffer bay, are inclined with respect to the horizontal, downward in the upstream sense, come into closure contact against the upstream transverse wall of the enclosure, near to the blister sheet, are translationally mobile and are linked, by their posterior ends, to independent means able to move them in one direction or the reverse, the control of the means of opening and closing each flap reacting, in respect of the upper flap, to a volumetric sensor detecting the quantity of tablets accumulated in the buffer bay and, in respect of the lower flap, to the sensor disposed above the travelling sheet, upstream of the first brush, and detecting the quantity of tablets accumulating against the first brush.

With this device, when the quantity of tablets accumulated against the first brush reaches a specified minimum volume, the corresponding sensor triggers the sliding of the lower flap and thus causes all or some of the content of the buffer bay to be emptied in small waves as close as possible to the filling zone.

Likewise, when the content of this bay reaches a minimum volume, the sensor associated therewith opens the upper flap, so that the latter allows some of the tablets contained in the reservoir to enter the bay. As soon as the maximum volume which can be accommodated in the bay is reached, the same sensor closes the flap.

It follows from this that the tablets stored in the reservoir are subjected to no vibration or movement which might damage them, through volume and weight of the tablets.

Advantageously, the lower end of the lower flap is, in the closure position, substantially in the horizontal diametral plane of the first brush.

Thus, transfers, respectively from the reservoir to the bay and from the bay to the distributing station, take place solely under gravity over small distances, and in small quantities, so that the kinetic energy imparted to the tablets is insufficient to damage them and form fragments and dust.

In one embodiment, the enclosure is fixed by dismantlable means on the vertical platen of a box which can be moved vertically on the runners of a chassis, disposed laterally to the conveyor moving the blister sheet, said box containing, for each of the brushes of the enclosure, an electric drive motor whose output shaft is equipped with means for rotational and translational linkage and with positioning means, all able to cooperate with complementary means made at the posterior end of the drive shaft for each brush.

This enclosure which will be fitted onto the power take-offs of the motorization disposed in the outer box, is interchangeable and may be specific to a product, thereby eliminating any risk of cross-contamination. This removability facilitates cleaning thereof and the cleaning of the station which can very rapidly be freed, all the more easily since all the elements in contact with the tablets are dismantlable.

Other characteristics and advantages will emerge from the description which follows with reference to the appended schematic drawing.

DESCRIPTION OF PREFERRED EMBODIMENTS

Figure 2:
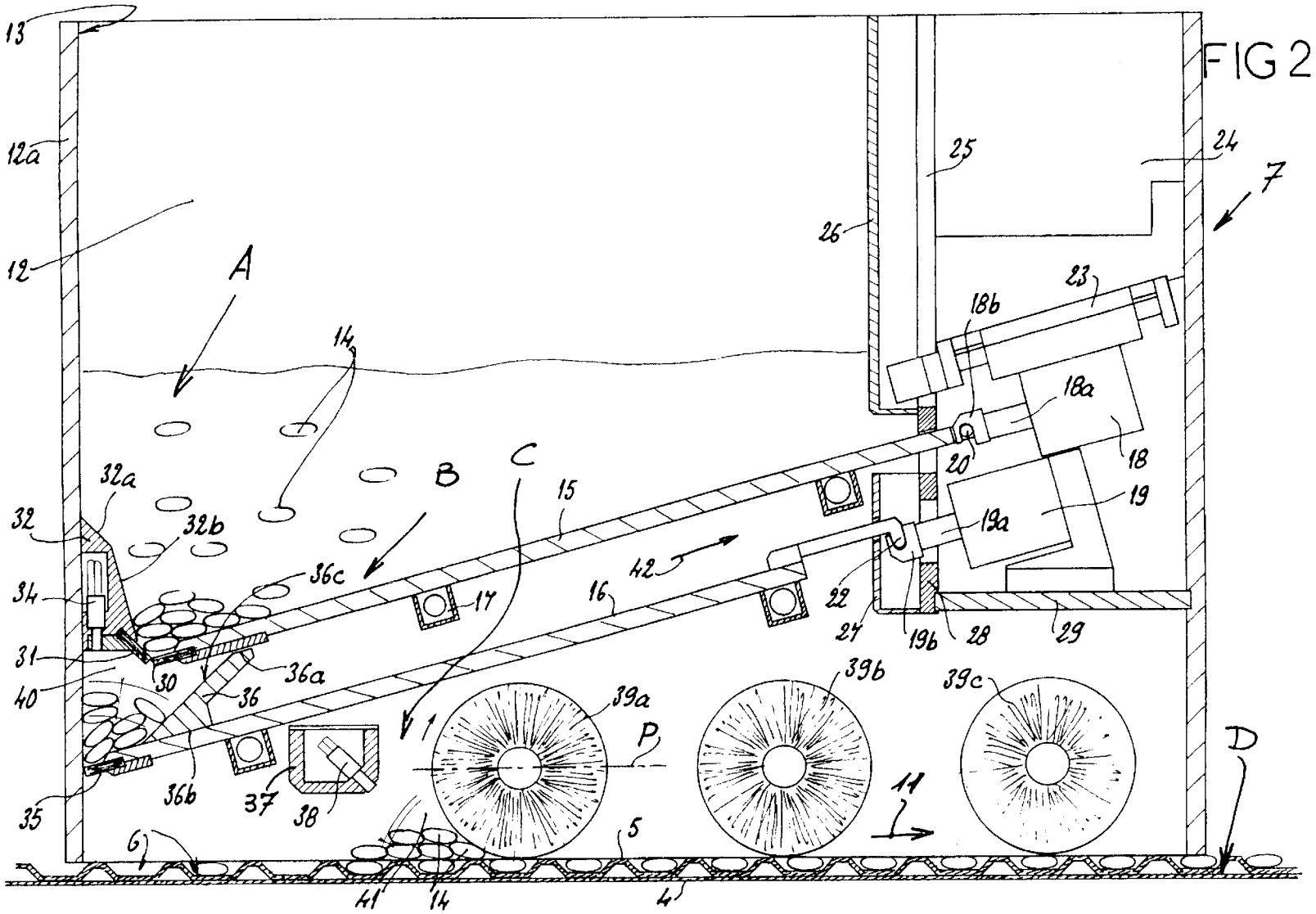
FIG. 2 is a longitudinal sectional view of the device, when it is in the working position.

The numerical reference 2 designates the chassis of a conveyor D carrying rollers or drums 3 for driving a belt 4 moving, in the direction of the arrow 11 of FIG. 2, a sheet of synthetic material 5 comprising preformed blisters 6, for example made by thermoforming.

Figure 1:
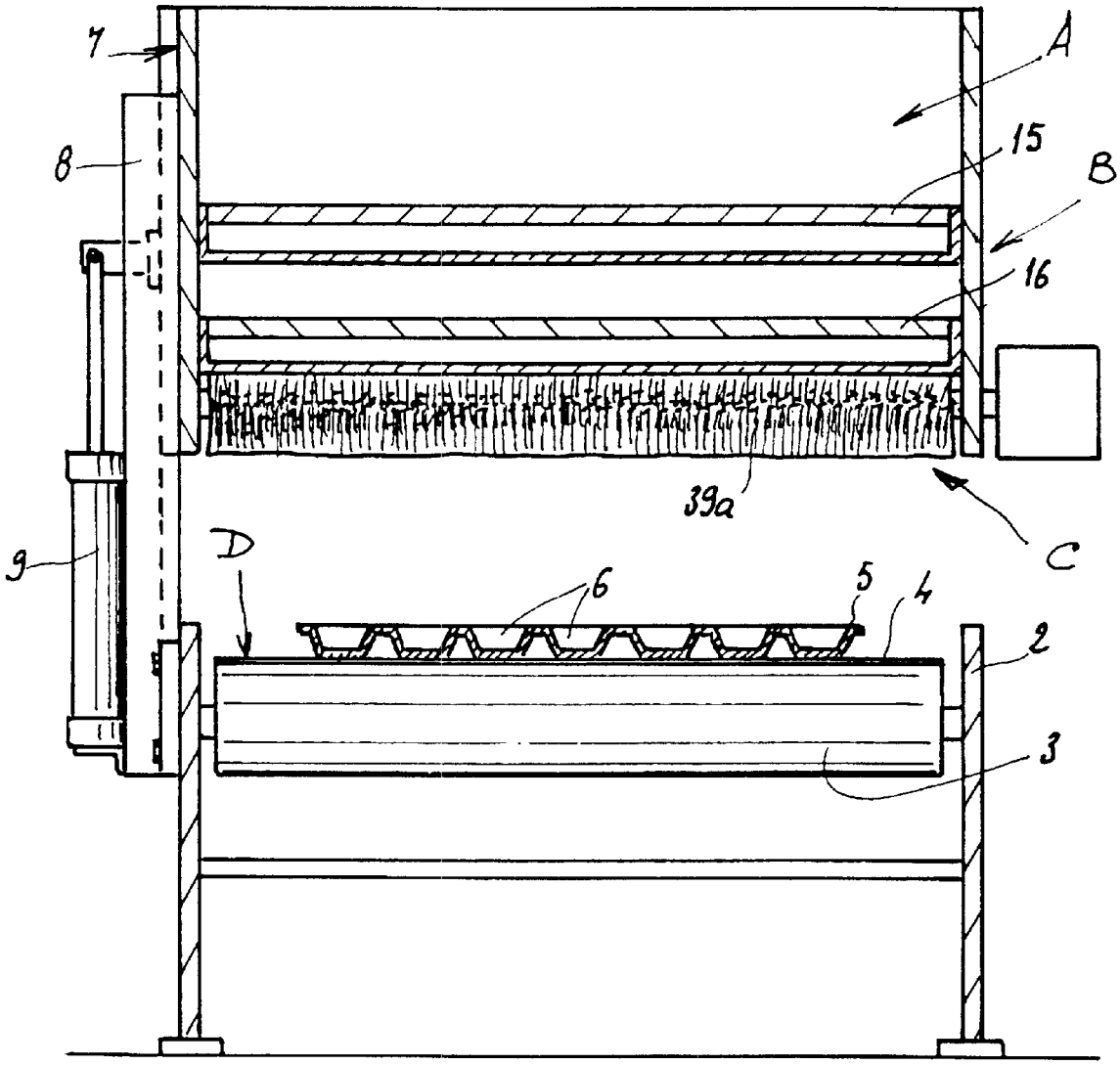
FIG. 1 is a transverse sectional view of an embodiment of this device, when it is set in place on the conveyor of a packaging installation and when it is in the clearance position.

In the embodiment of FIGS. 1 to 2, the enclosure 7 of the device according to the invention is mounted sliding on vertical runners 8 and is linked to means, such as a pneumatic or hydraulic ram 9, able to move it over these runners between a clearance position, represented with a thick line in FIG. 1, in which it is spaced apart from the belt conveyor, and a working position, represented in FIG. 2, in which its brushes are in proximity to this belt.

As shown in greater detail in FIG. 2, the enclosure 7 contains and carries a reservoir A, a dispensing means (dispenser) B for the tablets, and a distributing means (distributor) C for the tablets over the blister sheet 5. The reservoir A is delimited by the walls 12*a*, 12*b*, 12*c* of the enclosure and by a transverse wall 16. Through its upper opening 13, it can receive the tablets 14 which are to be dispensed. FIG. 1 shows that it extends transversely over the width of the conveyor and at least over that of the blister sheet 5.

The bottom of the reservoir consists of two flaps, namely an upper flap 15 and a lower flap 16. The two flaps are parallel, spaced apart and inclined with respect to the horizontal, downward in the downstream to upstream sense, at an angle having a value of between 10 and 30°. Each flap is mounted sliding in the reservoir and, more precisely, with respect to crosspieces 17 linking the walls 12*b*, 12*c* of the reservoir.

The upper end of each flap 15 and 16 is linked, by dismantlable means, to means able to move it longitudinally.

In the embodiment represented, the means consist of two electric motors, 18 and 19 respectively, actuating via a screw system two rods 18*a*, 19*a*, each of these rods is each fitted with an end hook 18*b*, 19*b* able to receive a complementary part such as a rail 20 secured to the upper end of the flap 15 or a hook-like rib 22 secured to the upper end of the flap 16. The two motors 18 and 19, and likewise the control means 23, making it possible among other things to adjust the travel of the flap 15, are disposed in a compartment 24. The latter is isolated, by vertical walls 25 and 26, from the reservoir A and, by walls 27, 28 and 29, from the dispensing means B and from the distributing means C.

The flaps 15 and 16 are intended, via their lower ends, to come into contact with a wall element of the enclosure 7, and more especially, with the upstream transverse wall 12*a* of this enclosure, so as to be able each to form, through their opening, two parallel overlying slots extending over the entire length of the reservoir and corresponding to the width of the travelling preformed web 5.

FIG. 2 shows clearly that the lower end of the lower flap 16 is, in the closure position, substantially in the horizontal diametral plane P of the brush 39*a*.

The lower end of the upper flap 15 is fitted with a rectilinear and transverse brush 30 which extends over the entire width of the reservoir A and is able to come against an opposite brush 31, made on the edge of a transverse bar 32. This bar, which is fixed against the upstream transverse wall 12*a* of the reservoir, for example by screws (not represented), exhibits, in the reservoir, two sloping faces 32*a*, 32*b* forming a kind of funnel guiding the tablets toward the zone of contact of the two brushes 30, 31 and, consequently, toward the discharge slot which forms when the upper flap 15 recoils.

The bar 32 also serves as housing for at least one volumetric sensor 34, and supports a suction network (not represented). It is removable so that it can be cleaned.

The lower end of the lower flap 16 is also fitted with a rectilinear and transverse brush 35 which comes directly against the inner face of the wall 12*a* of the reservoir, but which can also abut against a bar similar to the one 32.

A crosspiece 36, extending between the two longitudinal walls 12*b*, 12*c* of the enclosure 7, and between the two flaps 15 and 16, comprises two supporting faces which, parallel and opposite, are able, the upper 36*a*, to come into contact with the lower face of the upper flap 15 to prevent it bending at the end of closure, and the lower 36*b*, to abut against the upper face of the lower flap 16, so as to improve the translational guidance thereof.

The crosspiece 36 also has the function of delimiting, with the wall 12*a*, the longitudinal boundaries of a buffer bay 40. It comprises, facing the upstream transverse wall 12*a* of the enclosure, a sloping face 36*c* which, when the flap 15 is in the opening position, channels the tablets originating from the reservoir A and directs them into the buffer bay 40.

Finally, a crosspiece 37, disposed beneath the flap 16, carries another volumetric sensor 38 determining the quantity of tablets accumulated upstream of the first rotary and transverse brush 39*a*, associated with two other brushes 39*b*, 39*c*.

The two volumetric sensors, 34 and 38 respectively, are linked, by an electric circuit (not represented) and individually, to the control box 23, of the motors 18 and 19. Each of them reacts to the variation in volume of the tablets amassed in front of it. When this volume reaches a minimum value, it brings about the opening of the corresponding flap, whereas for the maximum value, it brings about closure thereof.

When this device is operating and as shown in FIG. 2, the buffer bay 40 contains a stock of tablets which is ready to feed the stock 41 formed upstream of the first brush 39*a*. The accumulated volume decreases as the tablets 14 from this stock are distributed into the blisters 6 of the travelling sheet 5. As soon as the volume reaches the minimum value, the sensor 38 reacts on the control of the motor 19 which triggers the sliding of the lower flap 16 in the direction of the arrow 42. As a result the brush 35 of the lower flap 16 retreats from the wall 12*a* and forms a slot through which a certain quantity of tablets 14 flows. The tablets 14 fall onto the travelling web 5 and are conveyed, by the latter, to the first brush 39*a*, rebuilding the stock 41. As soon as the maximum value of the volume of the stock 41 is reached, the sensor 38 reacts again so that the motor 19 instructs the flap 16 to move in the reverse direction so as to close the flow slot. By virtue of the brush 35, the closure has no effect on the tablets which, therefore, are not crushed.

If this unloading of the bay 40 has brought the volume stored in this bay to its minimum value, the sensor 34 reacts on the control means 23 so as to trigger the movement of the upper flap 15 in the direction of the arrow 42, and, consequently, cause the corresponding slot to open. Under these conditions, the tablets 14 stored in the reservoir A descend under gravity into the bay 40. As soon as the maximum volume is reached, the sensor 34 instructs the flap 15 to move in the reverse direction. Here again, during this closure, the brushes 30 and 31 prevent any pinching of the tablets 14 and any formation of dust and fragments.

It will be noted that, when the tablets drop from the reservoir A into the bay 40 and also when they drop from the bay 40 onto the thermoformed sheet 5, the drop height is very low, thereby preventing any fragmentation of the tablets under the weight of the other tablets and under the kinetic energy of the tablets falling on top of them. By virtue of this, and also of the presence of the buffer bay limiting the intermediate volume stored, the tablets are dispensed in batches of small quantity and under excellent conditions, with no breakage or dust.

At the end of the packaging operation, each of the two flaps 15, 16 is easily dismantled so as to be removed and cleaned, and also to enable the inside of the enclosure to be cleaned.

Figure 3:
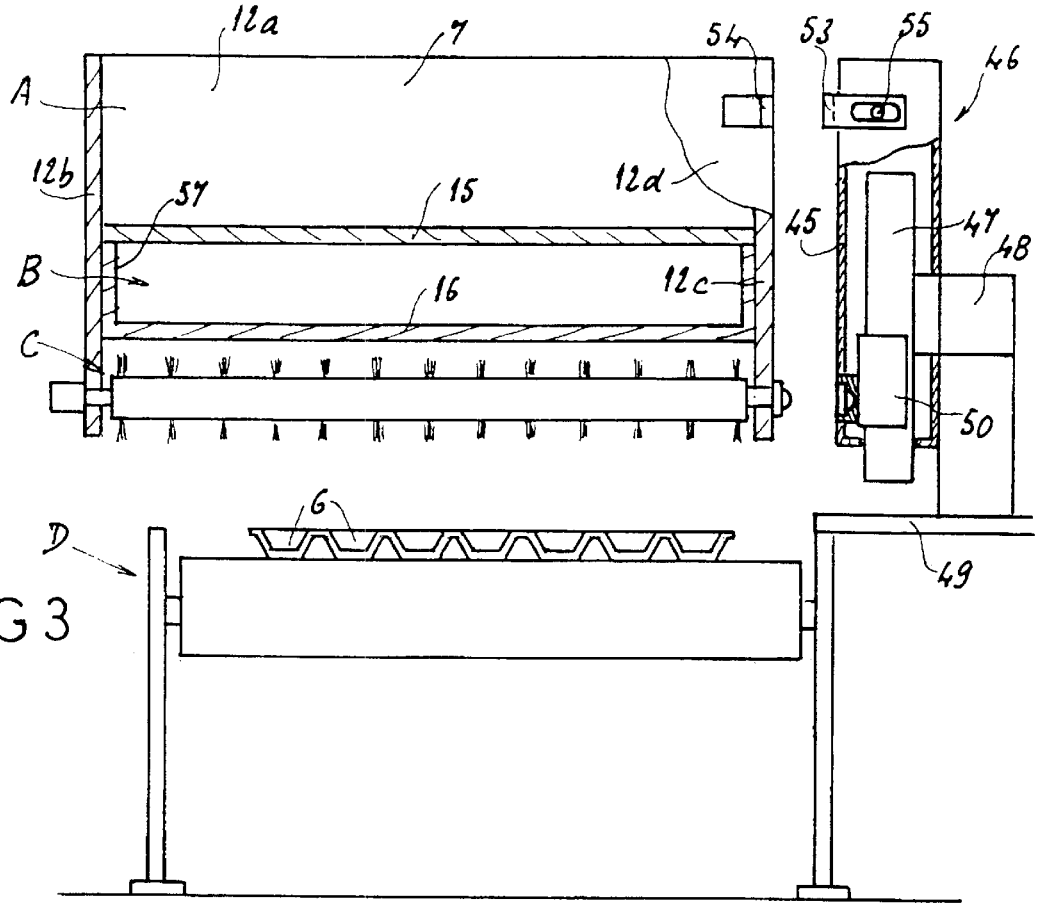
FIG. 3 is a side view in transverse section of another embodiment of the device, when the enclosure is being mounted.
Figure 4:
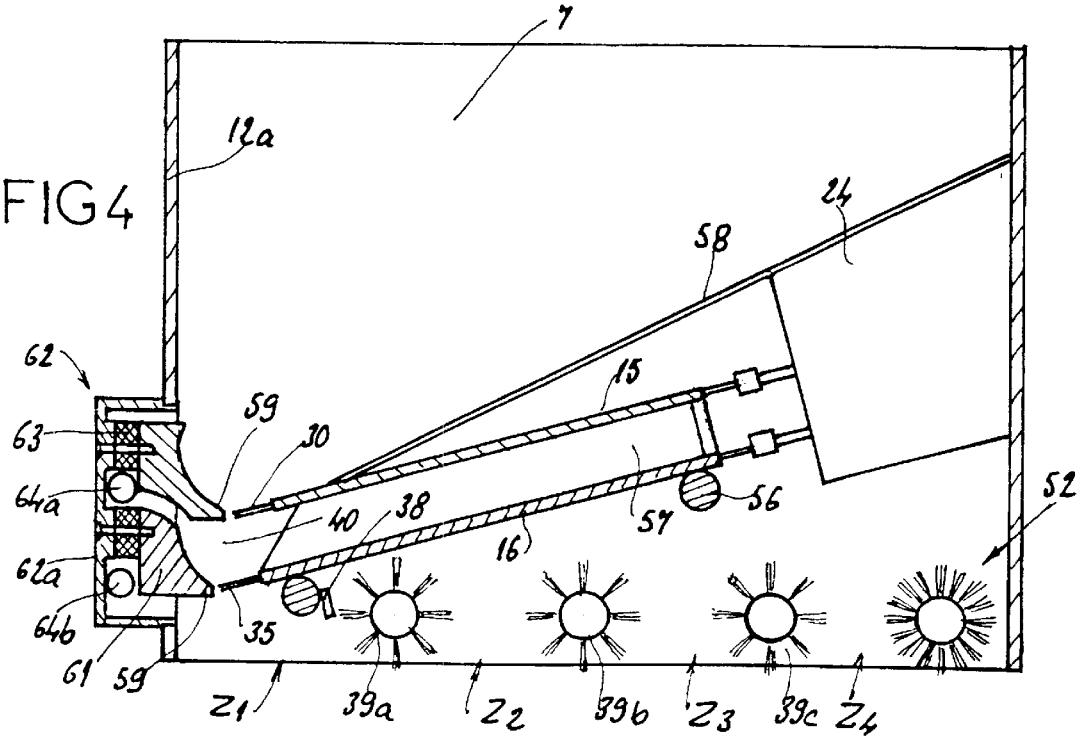
FIG. 4 is a view in longitudinal section of the enclosure of FIG. 3.
Figure 5:
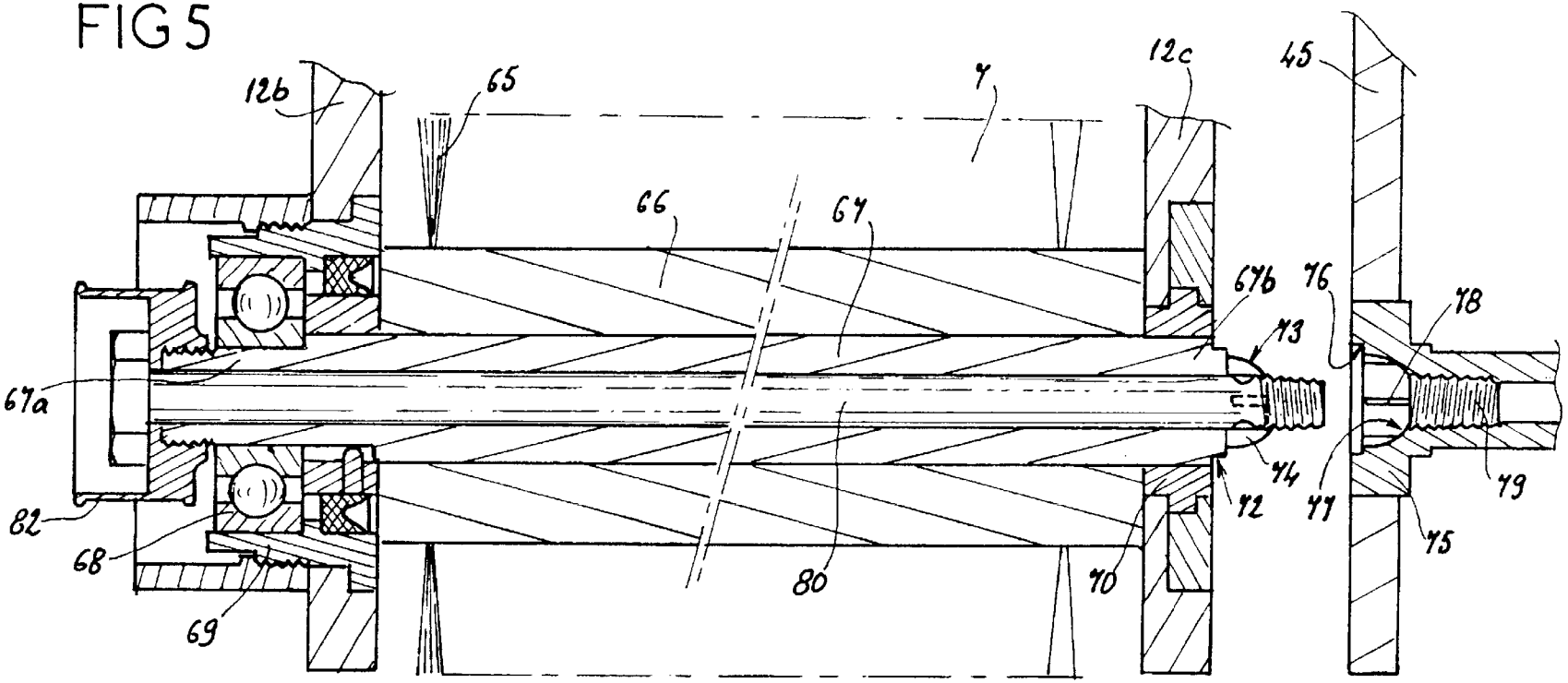
FIG. 5 is a partial view in transverse section showing on an enlarged scale the drive and linkage means for the shaft of a brush with its motorization.

The embodiment represented in FIGS. 3 to 5 differs from the previous one in a few particular points which will be highlighted. The means and members which are common to the two embodiments will bear the same references, while the new elements will be referenced from 45 onwards.

As shown by FIG. 3, the enclosure 7, containing the reservoir A, the dispenser B and the distributor C, is fixed in a dismantlable manner by supporting its longitudinal face 12*c* against a vertical platen 45 forming part of a box 46.

The box 46 is mounted sliding on vertical runners 47 carried by a bracket 48, secured to a fixed plinth 49, disposed laterally and outside the conveyor D. The movement of the box 46 can be effected by a screw/nut system which can be actuated by a crank or by electric control. The box contains as many electric motors 50 as the enclosure contains brushes, and, for example, four motors when the enclosure comprises, as represented in FIG. 4, three distributing brushes 39*a*, 39*b*, 39*c* and one smoothing brush 52.

Finally, the box 46 is equipped with means of linkage with the enclosure 7. In the embodiment represented, the means consist of four straps 53 disposed in pairs on the end faces of the box and cooperating with catches 54, projecting from the outer faces of the transverse walls 12*a* and 12*d* of the enclosure 7. Each strap is of the screw-locking 55 or toggle type.

FIG. 4 shows that the lower flap 16 slides on two cylindrical crosspieces 56 and comprises two lateral flanges 57 that serve as runners for the upper flap 15. A removable, attached bottom 58 supported on the top of the compartment 24 and on the flap 15 is more inclined than the flaps and forms a hopper causing the tablets to run toward the bottom of the reservoir A.

The rectilinear and transverse brushes 30, 35 made on the edges of the flaps 15 and 16 each abut against a tab 59 projecting from a bar 60, 61. Each bar is fixed with interposition of viscoelastic damping blocks 63 against the upstream transverse wall 62*a* of a box 62.

Thus, upon the closure of one of the slots of the dispenser B, if a tablet remains pinched between a flap and a bar, the pinching force causes the compression of the corresponding damping block and causes elastic recoil of the edge cooperating with the flap, preventing any damage to the tablet, and hence any formation of splinters or dust.

The box 62 is fixed against the transverse wall 12*a* of the enclosure 7 and contains two suction ports 64*a*, 64*b* communicating, the upper 64*a*, with the buffer bay 40 and, the lower 64*b*, with the zone Z1 where the tablets drop onto the blister sheet 5.

These ports suck up the dust formed by the rubbing together of the tablets in the reservoir A, in the bay 40, and in the zone Z1, and therefore clear the various distributing zones Z1 to Z4 of any dust.

The box 62 is equipped with a sensor 34 (not represented) just like the one 38 disposed above the zone Z1 near to the first brush, 39*a*. These sensors are dismantlable, like the box 62, the bottom 58, the flaps 15 and 16, and the brushes 38*a* to 38*c* and 52, to facilitate cleaning thereof and of the enclosure after it is dismantled from the platen 45.

When this platen is freed from the enclosure 7, it is very easily cleanable and, due to its disposition outside the conveyor D, can remain in place with its box 46 and its chassis 48, 49, without impeding the operation of a packaging line, even if this line is already equipped with another dispensing device. In this latter case, the dimensions of the platen, of the order of 600×450 mm enable it to be easily incorporated between two stations of the line.

The possibility of bringing the enclosure 7 into the clearance position, for example at a distance of 500 mm from the blister sheet 5, makes it possible not only to facilitate the cleaning of the workstation, but also to clear this station which is thus able to allow through a blister sheet 5 being filled by another distributing device.

The removability of the enclosure 7 of the device according to the invention makes it possible to facilitate the cleaning thereof outside of the packaging line and to assign each enclosure to a product type, thereby eliminating the risk of cross-contamination, and also to mount it rapidly on an existing line, temporarily shut down to satisfy a different and more urgent demand.

An embodiment of the means ensuring the linking of the brushes disposed in the enclosure 7 with the drive means disposed in the box 46 will now be described with reference to FIGS. 3 and 5.

Each brush 39 and 52 is formed by tufts of bristles 65 projecting from a tubular sleeve 66 tied rotationally to a tubular shaft 67. This shaft is mounted freely in rotation, via its anterior end 67*a*, in a journal 68 carried by a bearing 69 of an anterior longitudinal wall 12*b* of the enclosure 7, and via its posterior end 67*b* in a bearing 70 carried by the wall 12*c* of the enclosure.

The posterior end 67*b* of the shaft 67 projects from the wall 12*c* via a shouldered cylindrical part 72 and via a hemispherical tip 73 in which radial slots form dogs 74.

The output shaft of each electric motor 50 of the box 46 is rotationally and translationally secured to a tulip 75 whose end face is flush with the face of the platen 45 receiving the posterior face of the enclosure. This tulip comprises a shouldered bore 76, a hemispherical dish 77, in which castings form dogs 78 complementary to those of the shafts 67 of the brushes, and a threaded axial well 79.

When the enclosure 7 is presented against the platen 45, the hemispherical tips 73 facilitate the prepositioning of the shafts 67 facing the tulips 75, then the axial and radial positioning is effected by engaging the shouldered spans 72 of the shafts in the bores 76. This engagement brings the dogs 74 against those 78 of the tulip so as to effect the rotational linkage of each tulip with its shaft. The translational linkage of these two elements is achieved via a screw 80 whose shank passes axially through the shaft 65 so as to screw into the threaded axial well 79 of the tulip and whose head abuts on the anterior end 67*a* of the shaft. In the embodiment represented, the head abuts on the bottom of a protective cup 82, inserted between it and the shaft.

This device accommodates all shapes of tablets, and if need be, can be mounted without difficulty on existing installations, since it does away not only with vibratory feeders, but also with conduits transferring the tablets from the vibratory feeder to the dispensing zone.

Likewise, it can be attached to an installation comprising other dispensing means, for example, so as to improve poor filling or temporarily increase the hourly production.

It is apparent that the device, according to the invention, makes it possible not only to satisfy the hygiene rules and to obtain quality packs, but also makes it possible to improve the loading schedule of existing installations and, consequently, of an entire packaging plant.

What is claimed is:

1. A device for feeding tablets to blisters in a travelling blister sheet, the device comprising:

a) a reservoir for storing the tablets, b) a dispenser for dispensing a batch of tablets through an opening of the reservoir extending over the width of the travelling blister sheet, and c) a distributor for distributing the tablets into the blisters in the travelling blister sheet, the distributor comprising one or more cylindrical and rotary brushes, the device further comprising a single enclosure containing and carrying the reservoir and the dispenser comprising two parallel flaps comprising an upper flap and a lower flap which, forming a bottom of the reservoir and delimiting a buffer bay, are each inclined with respect to the horizontal, and downward in an upstream direction, come into closure contact against an upstream transverse wall of the enclosure, near to the travelling blister sheet, are translationally mobile and are linked, at posterior ends thereof, to two respective independent motors able to move the flaps in one direction or a reverse direction to thereby open or close each flap, and wherein control of the respective independent motors for opening and closing each flap reacting, in respect of the upper flap, to a volumetric sensor detecting a quantity of tablets accumulated in the buffer bay and, in respect of the lower flap, to a sensor disposed above the travelling blister sheet, upstream of a first cylindrical and rotary brush, and detecting a quantity of tablets accumulating against the first cylindrical and rotary brush.

2. The device as claimed in claim 1, wherein a lower end of the lower flap is, in the closure position, substantially in a horizontal diametral plane of the first cylindrical and rotary brush.

3. The device as claimed in claim 1, wherein a lower edge of at least the upper flap comes into contact with a transverse bar which, attached against the upstream transverse wall of the enclosure, is disposed above the buffer bay, forms a delivery guide for the tablets of the reservoir and contains at least one volumetric sensor detecting the volume of tablets accumulated in the buffer bay.

4. The device as claimed in claim 3, wherein opposing edges of the upper flap, of the bar or both are fitted with a rectilinear and transverse brush.

5. The device as claimed in claim 1, wherein the upper flap cooperates with a first bar and the lower flap cooperates with a second bar, wherein each bar is fixed against a transverse wall of the enclosure with interposition of a viscoelastic damping block between the transverse wall and an edge of each bar, the viscoelastic damping block cooperating with each respective flap, to recoil elastically in the event of abnormal closing force.

6. The device as claimed in claim 5, wherein the first bar and the second bar are disposed in a box attached against the upstream transverse wall of the enclosure and each of the bars is associated with a suction port, an upper suction port communicating with the buffer bay and a lower suction port communicating with a zone for receiving the tablets on the travelling blister sheet.

7. The device as claimed in claim 5, wherein the opposing edges of the upper flap, of the bar, or both, and the opposing edges of the lower flap, of the bar, or both are fitted with a rectilinear and transverse brush.

8. The device as claimed in claim 1, wherein the flaps are removable with respect to the respective motors and are each linked by a dismantlable linkage, of complementary hooks, to an upper end of the corresponding flap.

9. The device as claimed in claim 1, wherein the enclosure is mounted sliding with respect to runners of a fixed chassis and is linked to a device able to move the enclosure vertically between a working position, in which the cylindrical and rotary brushes are in proximity to or in contact with the travelling blister sheet, and a clearance position in which the cylindrical and rotary brushes are remote from a trajectory of the travelling blister sheet.

10. The device as claimed in claim 1, wherein the enclosure is fixed by dismantlable attachment on a vertical platen of a box which can be moved vertically on runners of a chassis, disposed laterally to a conveyor moving the travelling blister sheet, said box containing, for each of the cylindrical and rotary brushes of the enclosure, an electric drive motor whose output shaft is equipped for rotational and translational linkage and with a positioner, all able to cooperate with complementary dogs, screw, or shouldered cylindrical span made at a posterior end of a drive shaft for each cylindrical and rotary brush.

11. The device as claimed in claim 10, wherein the drive shaft of each brush is tubular, is mounted free to rotate in bearings made in longitudinal walls of the enclosure and exhibits, at the posterior end projecting from the enclosure, a hemispherical tip with dogs and a shouldered cylindrical span, while the output shaft of the electric drive motor is secured to a tulip flush with the platen supporting the enclosure, said tulip comprising a threaded axial well, a hemispherical dish with dogs, which are complementary to the tip of the drive shaft of the cylindrical and rotary brush, and a shouldered bore for receiving a shouldered span of the drive shaft, the translational linkage between the tulip and the drive shaft of the cylindrical and rotary brush being catered for by an axial screw disposed in the drive shaft and whose threaded end is screwed into the threaded axial well of the tulip and whose head is supported on an anterior end of said drive shaft.

* * * * *